US010557300B2

(12) United States Patent
Tagtow et al.

(10) Patent No.: US 10,557,300 B2
(45) Date of Patent: Feb. 11, 2020

(54) GARAGE DOOR ACCESS REMOTE

(71) Applicant: Amesbury Group, Inc., Amesbury, MA (US)

(72) Inventors: Gary E. Tagtow, Sioux Falls, SD (US); Matt Halbersma, Brandon, SD (US); Douglas John Criddle, Sioux Falls, SD (US); Michael Lee Anderson, Sioux Falls, SD (US); Tracy Lammers, Sioux Falls, SD (US)

(73) Assignee: AMESBURY GROUP, INC., Amesbury, MA (US)

( * ) Notice: Subject to any disclaimer, the term of this patent is extended or adjusted under 35 U.S.C. 154(b) by 0 days.

(21) Appl. No.: 16/014,963

(22) Filed: Jun. 21, 2018

(65) Prior Publication Data

US 2019/0024437 A1 Jan. 24, 2019

Related U.S. Application Data

(60) Provisional application No. 62/534,298, filed on Jul. 19, 2017.

(51) Int. Cl.

| | |
|---|---|
| ***E05F 15/76*** | (2015.01) |
| ***E05F 15/77*** | (2015.01) |
| ***E05F 15/681*** | (2015.01) |

(52) U.S. Cl.

CPC ..... *E05F 15/76* (2015.01); *E05F 15/77* (2015.01); *E05F 15/681* (2015.01); *E05Y 2400/85* (2013.01); *E05Y 2800/424* (2013.01); *E05Y 2800/426* (2013.01); *E05Y 2900/106* (2013.01)

(58) Field of Classification Search

None

See application file for complete search history.

(56) References Cited

U.S. PATENT DOCUMENTS

| | | | | |
|---|---|---|---|---|
| 4,716,992 | A * | 1/1988 | Kunii | B66B 1/461 187/391 |
| D404,673 | S | 1/1999 | Gordon et al. | |
| D421,727 | S | 3/2000 | Person et al. | |
| 6,346,889 | B1 | 2/2002 | Moss | |
| D501,652 | S | 2/2005 | Pierson et al. | |
| 7,365,634 | B2 | 4/2008 | Brookbank | |
| 7,602,283 | B2 | 10/2009 | John | |
| 7,692,533 | B2 | 4/2010 | Chiba et al. | |
| 8,437,916 | B2 | 5/2013 | Fawaz et al. | |
| D689,828 | S | 9/2013 | Pierson | |
| 8,665,065 | B2 | 3/2014 | Jenkins et al. | |

(Continued)

*Primary Examiner* — Carlos Garcia

(57) ABSTRACT

An access system for a structure includes a control box mounted within a controlled access space of the structure and operatively coupled to a door panel operator that opens and closes a door panel of the structure for access to the controlled access space. The control box is configured to detect a presence of a security device relative to the control box, determine a position of the security device relative to the structure, and determine an authorization of the security device. The access system also includes a user interface mounted in an uncontrolled access space of the structure and coupled in communication with the control box. Upon actuation of the user interface, the control box operates the door panel operator when the security device is positioned proximate the control box, located in the uncontrolled access space of the structure, and authorized to operate the door panel.

18 Claims, 11 Drawing Sheets

(56) References Cited

U.S. PATENT DOCUMENTS

| | | | | |
|---|---|---|---|---|
| 8,866,583 | B2 | 10/2014 | Ordaz | |
| 9,251,677 | B1 | 2/2016 | Mika | |
| 9,376,851 | B2 | 6/2016 | Cate et al. | |
| 9,852,561 | B2 * | 12/2017 | Dumas | G07C 9/00309 |
| 2010/0026487 | A1 | 2/2010 | Hershkovitz | |
| 2010/0060413 | A1 | 3/2010 | Fitzgibbon et al. | |
| 2013/0027180 | A1 | 1/2013 | Lakamraju et al. | |
| 2014/0125453 | A1 * | 5/2014 | McIntyre | H04L 63/0853 340/5.7 |
| 2015/0137941 | A1 | 5/2015 | Bauer et al. | |
| 2015/0141076 | A1 | 5/2015 | Libin et al. | |
| 2016/0104374 | A1 | 4/2016 | Ypma et al. | |
| 2016/0191912 | A1 | 6/2016 | Lea et al. | |
| 2016/0343185 | A1 * | 11/2016 | Dumas | G07C 9/00309 |
| 2019/0032368 | A1 * | 1/2019 | Welbig | E05B 47/0012 |

* cited by examiner

GARAGE DOOR ACCESS REMOTE

CROSS-REFERENCE TO RELATED APPLICATIONS

This application claims priority to and the benefit of U.S. Provisional Patent Application No. 62/534,298, filed on Jul. 19, 2017, the disclosure of which is hereby incorporated by reference in its entirety.

INTRODUCTION

Garage doors can be large doors that open by an electric motor and enable access into a structure. The motor may be controlled through wired or wireless access control systems located inside and/or outside of the garage door. Some known access control systems may include a keypad positioned outside the garage door that is used for entering an access code for opening and/or closing the garage door. However, as the keypad is positioned outside of the garage door, the access control system is vulnerable to intrusion attempts. In other known access control systems, the garage door may be operationally controlled through a smartphone application. However, to gain access through the garage door, a user must go through a multi-step navigation process.

SUMMARY

In an aspect, technology relates to an access system for a structure, the access system includes: a control box mounted within a controlled access space of the structure and operatively coupled to a door panel operator that opens and closes a door panel of the structure for access to the controlled access space, wherein the control box is configured to (i) detect a presence of a security device relative to the control box, (ii) determine a position of the security device relative to the structure, and (iii) determine an authorization of the security device; and a user interface mounted in an uncontrolled access space of the structure and coupled in communication with the control box, the user interface including a single button, wherein upon actuation of the single button, the control box operates the door panel operator when the security device is (i) positioned proximate the control box, (ii) located in the uncontrolled access space of the structure, and (iii) authorized to operate the door panel.

In an example, the access system further includes a sensor configured to determine a position of the door panel relative to the structure such that when the door panel is closed, the control box operates the door panel operator to open the door panel, and when the door panel is open, the control box operates the door panel operator to close the door panel. In another example, the sensor includes a magnetic actuator and a switch. In yet another example, the switch is coupled in communication to the control box by a wire cable. In still another example, the user interface is coupled to the control box by a wire cable. In an example, the user interface includes at least one visual indicator configured to indicate a status condition of the control box in relation to operating the door panel operator.

In another example, the control box is mounted on a wall of the structure that is the same wall that the user interface is mounted on. In yet another example, the control box including at least two antennas for determining position of the security device, and a first antenna is directed to the controlled access space of the structure and a second antenna is directed to the uncontrolled access space of the structure. In still another example, the control box includes at least one of an audio indicator and a visual indicator configured to indicate operation of the door panel operator.

In another aspect, the technology relates to an access system kit for a garage door operator configured to open and close a garage door relative to a structure, the kit including: a control box for mounting within a controlled access space of the structure, the control box being operably connectable to the garage door operator and configured to (i) detect a presence of a security device relative to the control box, (ii) determine a position of the security device relative to the structure, and (iii) determine an authorization of the security device; and a user interface for mounting in an uncontrolled access space of the structure and including a single button, the user interface being communicatively connectable to the control box such that upon actuation of the single button, the control box operates the garage door operator when the security device is (i) positioned proximate the control box, (ii) located in the uncontrolled access space of the structure, and (iii) authorized to operate the garage door.

In an example, the kit further includes a sensor configured to determine a position of the garage door relative to the structure, the sensor includes a magnetic actuator and a switch, and a wire cable configured to communicatively connect the switch to the control box. In another example, the kit further includes a wire cable configured to connect the user interface to the control box. In yet another example, the kit further includes a wire cable configured to connect the control box to the garage door operator. In still another example, the user interface includes an inner housing including a first end and a second end defining a longitudinal axis therethrough, the second end being configured to be mounted within the uncontrolled access space of the structure; a contact switch disposed within the inner housing; a button mounted to the first end of the housing, the button being aligned with the contact switch along the longitudinal axis, and upon actuation of the button the contact switch is actuated; and an outer housing configured to surround at least a portion of the inner housing, the outer housing defining an opening, and at least a portion of the first end and the button are disposed within the opening. In an example, the user interface further includes a visual indicator disposed within the inner housing, the inner housing is at least partially transparent such that the visual indicator is visible through the opening of the outer housing and at least partially surrounding the button.

In another aspect, the technology relates to a method of operating a door panel of a structure, the method including: receiving an actuation signal at a control box from a user interface mounted in an uncontrolled access space of the structure; detecting, by the control box, a presence of a security device relative to the control box, wherein the control box is coupled in communication with the user interface and is mounted within a controlled access space of the structure; determining, by the control box, a position of the security device relative to the structure; determining, by the control box, an authorization of the security device; and controlling a door panel operator configured to open and close the door panel based on the security device being (i) positioned proximate the control box, (ii) located in the uncontrolled access space of the structure, and (iii) authorized to operate the door panel, wherein the control box is operably connected to the door panel operator.

In an example, the method further includes sensing a position of the door panel relative to the structure by a sensor such that when the door panel is closed, the control box controls the door panel operator to open the door panel, and when the door panel is open, the control box controls the door panel operator to close the door panel. In another example, the method includes emitting a visual signal from the user interface based on a status condition of the control box in relation to controlling the door panel operator. In yet another example, the method includes emitting at least one of a visual and an audible signal from the control box associated with control of the door panel operator. In still another example, determining the position of the security device includes at least one of identifying a signal from the security device on a first antenna that is directed towards the uncontrolled access space and identifying a signal from the one or more security device on a second antenna that is directed towards the controlled access space.

BRIEF DESCRIPTION OF THE DRAWINGS

There are shown in the drawings, examples which are presently preferred, it being understood, however, that the technology is not limited to the precise arrangements and instrumentalities shown.

DETAILED DESCRIPTION

Figure 1:
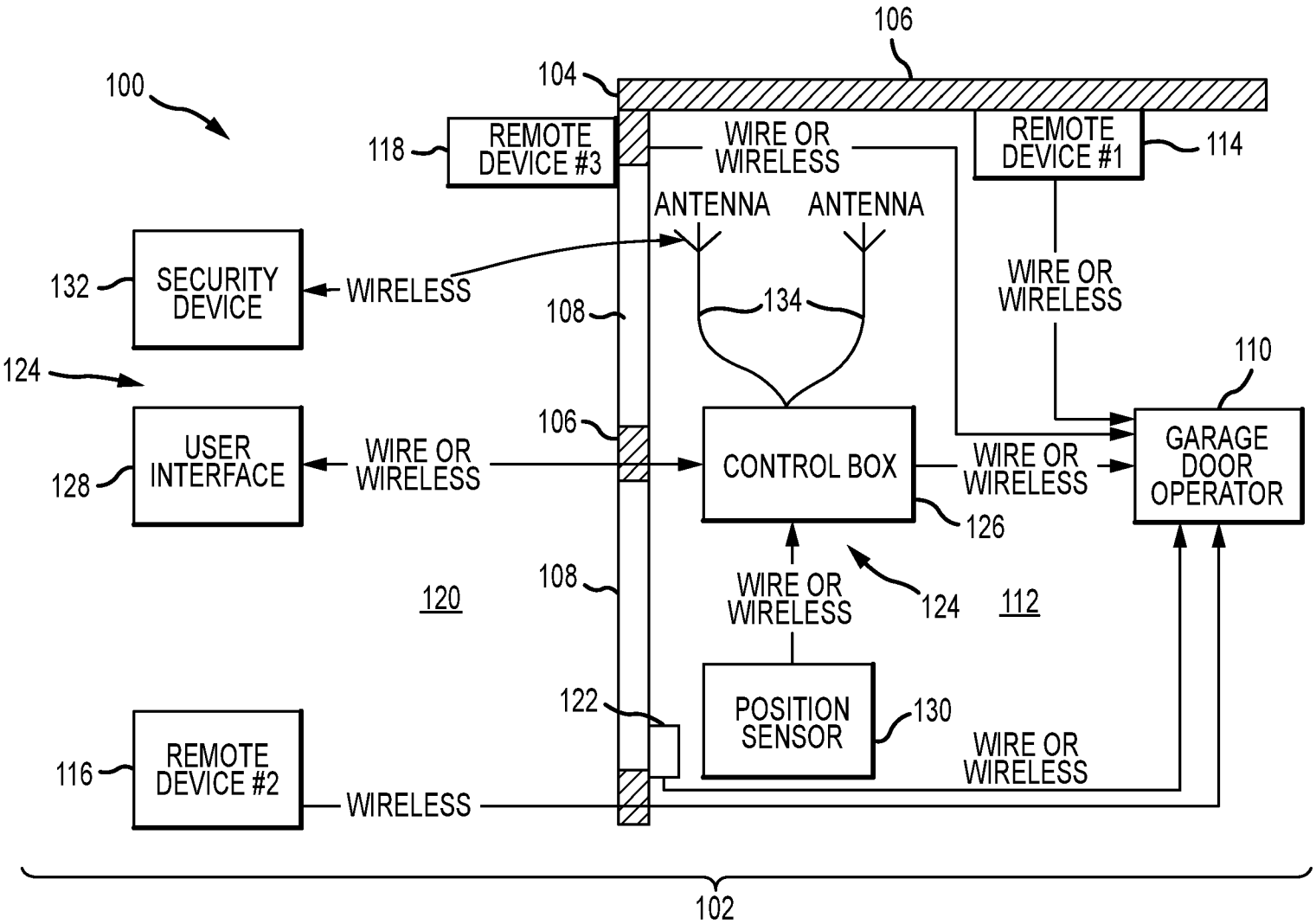
FIG. 1 is a schematic view of a garage door system in a first operating condition.

FIG. 1 is a schematic view of a garage door system 100 in a first operating condition 102. In the example, a structure 104 may be formed by a plurality of walls 106, with one or more of the walls 106 having one or more garage doors 108. The garage door 108 is configured to open (e.g., enabling access through the wall 106 and into the structure 104) and close (e.g., restricting access into the structure 104). A garage door operator 110 can be coupled to the garage door 108 and configured to move the garage door 108 between the open and closed positions. In one example, the garage door operator 110 can be a motor and pulley or chain system that raises and lowers the garage door 108. An interior space 112 is defined by the walls 106 and/the garage door 108 of the structure 104 such that a controlled access space is formed (e.g., an area that access therein is limited as required or desired). The garage door operator 110 is generally located within the interior space 112 and is protected from the elements and from unwanted meddling.

The garage door 108 may be opened and closed by one or more remote devices 114, 116, and 118 that are in operational control of the garage door operator 110. In an example, the first remote device 114 may be an interior wall mounted switch that is directly in communication with the garage door operator 110 via a wired or wireless connection so that the garage door 108 can be opened and closed when a user is inside of the structure. In a wired connection, the switch can be disposed within a user interface and may facilitate a line closure at the garage door operator 110, which enables operation of the garage door operator 110. In another example, the second remote device 116 may be a remote control that can be located in an outside space 120 of the structure 104 (e.g., located and stored in a vehicle, or may be the vehicle itself via programmable components) that is directly in communication with the garage door operator 110 via a wireless connection so that the garage door 108 can open and close. In a wireless connection, the remote control communicates with the garage door operator 110 via wireless protocols, which enables remote operation of the garage door operator 110 (e.g., from the exterior space 120 of the structure 104). The exterior space 120 forms an uncontrolled access space of the structure 104 such that access therein is generally not limited. In still another example, the third remote device 118 may be an exterior wall mounted switch that is directly in communication with the garage door operator 110 and in parallel with the first remote device 114 via a wired or wireless connection. The switch may include a user interface, such as a keypad so that an access code (e.g., 4 to 6 digit PIN) may be used to operate the garage door operator 110 and open and close the garage door 108. However, since the keypad is outside of the structure 104, it is vulnerable to unwanted meddling and often difficult to program through the keypad.

In the examples, the communication signals between the remote devices 114, 116, and 118 and the garage door operator 110 may be a relay closure, a vehicle-based wireless control system (e.g., a HomeLink wireless signal from Gentex Corporation), a remote control radio code (e.g., Chamberlain's Security+2.0 serial protocol), or any other communication signal that enables operation of the garage door operator 110 as described herein. The garage doors 108 may also include a sensor 122 that is located near the floor of the structure 104 and detects whether objects are in the closing path of the garage door 108 to prevent the garage door 108 from closing on a vehicle, a person, or other object. When objects are detected in the path of the closing garage door 108 by the sensor 122, the garage door operator 110 will automatically reverse so that the garage door 108 does not close on any objects. The communication between the sensor 122 and the garage door operator 110 may be wired or wireless as required or desired. Other sensors, such as motion sensors, light sensors, heat sensors, and/or $CO_2$ sensors may also be coupled to the garage door operator 110 and facilitate operation thereof (e.g., opening and closing the garage door 108).

Additionally or alternatively, the garage door system 100 can also include an access system 124 that is operably coupled to the garage door operator 110 and enables the garage door 108 to open and close. For example, the second and/or third remote devices 116, 118 may not be present for a pedestrian accessing the structure 104 through the garage door 108. In the example, the access system 124 includes a control box 126, a user interface 128, and a position sensor 130. The control box 126 is mounted within the inside space 112 of the structure 104 and operatively coupled to the garage door operator 110. The control box 126 may be physically connected to the garage door operator 110 by a wire cable (e.g., a 2-condutor cable), and for example, in parallel with the remote devices 114, 116. In other examples, the control box 126 may wirelessly connect to the garage door operator 110 by a relay and protocols determined by the garage door operator 110 (e.g., a HomeLink wireless signal or a Chamberlain's Security+2.0 serial protocol). The user interface 128 can be mounted on the outside space 120 of the structure 104 and coupled in communication with the control box 126. The user interface 128 may be physically connected to the control box 126 by a wire cable (e.g., a 2-conductor cable), or wirelessly as required or desired.

In the example, the user interface 128 includes a single button that upon actuation can control (e.g., open and/or close) the garage door 108 from the outside space 120 without any of the remote devices 114, 116, and 118. The user interface is described further below in reference to FIGS. 4-5D, and may also include audio and/or visual indicators to indicate a status condition of the garage door 108 or control box 126. The user interface 128 communicates with the garage door operator 110 via the control box 126. Because the user interface 128 is a single button that is located in the exterior space 120, the access system 124 is easy to operate. In order to open/close the garage door 108, a user need only press the user interface 128 without having to enter an access code. However, for security and/or any other reasons, the control box 126 is configured to restrict access to the garage door operator 110 to only authorized users. This enables the access system 124 to prevent unauthorized access through the garage door 108, while still utilizing a single access button for ease of use.

To provide user authorization for the control box 126 and the user interface 128, a security device 132 can be used. The security device 132 may be a mobile device such as a phone or a key fob that can wirelessly communicate with the control box 126. Before using the access system 124, one or more security devices 132 can be linked (e.g., authenticated) with the control box 126 so that access through the garage door 108 is restricted and not available to everyone. In one example, once the security device 132 is authenticated with the control box 126, an authentication code can be stored in the security device 132 so that the control box 126 can search and determine if the security device 132 matches an authorized device when the user interface 128 is actuated. In other examples, any other authorization protocols may be used to link the security device 132 and the control box 126 as required or desired.

When the security device 132 includes key fobs for use with the access system 124, the key fob may be pre-loaded with an authentication code that is uploaded to the control box 126 for subsequent authorization determinations. Authentication may also be provided by a dedicated computer application on the security device 132 (e.g., mobile phone) that can connect to the control box 126. Use of the application enables an intuitive user interface to manage authenticated devices within the control box 126 and facilitate ease of use of the access system 124.

After the initial setup between the security device 132 and the control box 126, access through the garage door 108 is easy to operate via the user interface 128. Additionally, the communication transmitted between the security device 132 and the control box 126 can be encrypted with high-level encryption codes and provide resistance to malicious intrusion attempts. In comparison with other systems (e.g., the keypad of the third remote device 118), the user interface is greatly simplified with a single button and use of an application to manage the authenticated device(s). Further, although the user interface 128 remains mounted outside of the structure, it is less vulnerable to unwanted meddling because the control box 126 is positioned between the user interface 128 and the garage door operator 110, and within the structure 104. Additionally, in comparison with other systems (e.g., a smartphone application for garage door control), the security device 132 and the control box 126 can communicate automatically so that the operation of the garage door 108 requires only a single button and not a multi-step application procedure.

In other examples, the control box 126 can be configured (e.g., through the user interface application) to temporarily enable the user interface 128 without requiring the security device 132. This can enable third parties (e.g., repair people, dog walkers, movers, etc.) to have temporary access to the garage door 108 as required or desired while still maintain security of the access system 124. For example, the user interface 128 may be enabled for a predetermined number of uses, a predetermined date/time range for use, or a one-time only use without the security device 132 being present. In still other examples, the access system 124 may generate temporary authorization codes (e.g., through the user interface application) that can be sent to third parties for temporary access to the garage door 108. These temporary authorization codes may be enabled for a predetermined number of uses or a predetermined date/time range for use.

The control box 126 includes one or more antennas 134 so that the security device 132 can communicate with the control box 126 by transmitting and/or receiving communications. The control box 126 is described further below in reference to FIGS. 6A and 6B. The antennas 134 can have a predetermined range area (e.g., approximately 10 feet, 15 feet, 20 feet, etc.) such that the security device 132 must be present within the range area in order for the access system 124 to authorize the security device 132 and to be enabled for the operation of the garage door 108. In some examples, the range area of the antennas 134 may be user defined in the control box 126, for example, through the application user interface. By defining the range area of the access system 124, the operation of the garage door 108 can be limited to only when the security device 132 is located proximate the user interface 128. This reduces the possibility of the access system 124 being enabled after authorized users leave the structure 104 or when authorized users are merely walking by the structure 104.

In addition to the access system 124 detecting the presence of the security device 132, the access system 124 also can determine the position of the security device 132 relative to the structure 104 so that the access system 124 is not enabled when authorized users are located within the inside space 112. In the example, the control box 126 has two antennas 134 such that the control box 126 can determine a position of the security device 132 relative to the structure 104 (e.g., within the inside space 112 or within the outside space 120). As illustrated in FIG. 1, the security device 132 is shown in a first operating condition 102 and within the outside space 120. In this condition, the antenna 134 that is positioned and directed towards the outside space 120 receives the strongest signal from the security device 132 such that the control box 126 can determine that the security device 132 is outside of the structure. In other examples, the access system 124 can determine position of the security device 132 relative to the structure 104 by any other method as required or desired (e.g., triangulation, trilateration, multilateration, etc.).

In operation of the access system 124, upon actuation of the user interface 128, the control box 126 is configured to detect a presence of the security device 132 relative to the control box 126 to verify that the security device 132 is within range; determine a position of the security device 132 relative to the structure 104 (e.g., inside or outside); and determine whether the security device 132 is authorized for use with the garage door 108. When there is an authorized device within range of the control box 126 and outside of the structure 104, the control box 126 will control the garage door operator 110 and open or close the garage door 108. It should be appreciated that the access system 124 may perform any of the above operation steps in any sequence as required or desired. For example, the control box 126 may automatically search for the security devices 132 at predetermined time periods (e.g., every 10 seconds). Thus, the control box 126 can pre-determine whether an authorized device is present and outside of the structure 104 before the user interface 128 is actuated. In other examples, the access system 124 may first determine authorization of the security device 132 and then determine its relative position before enabling operation of the garage door 108.

In some examples, the control box 126 may provide an audible and/or visual indicator during the operation of the garage door 108. This enables audible and/or visual feedback for users during control of the garage door operator 110 by the control box 126. Additionally or alternatively, an audible and/or visual indicator may also be provided at the user interface 128. This enables audible and/or visual feedback for users on the status of the control box 126 in relation to the operation of the garage door 108. For example, the audible and/or visual indicator may be a status indicator at the user interface 128, such that when the authorized device is present and outside of the structure 104, a confirmed/success status may be indicated. Further, when no authorized devices are present or outside the structure 104, an error status may be indicated. In alternative examples, the user interface 128 may include one or more antennas 134 so as to determine the location of the security device 132 and/or authorize the security device 132 as required or desired.

The access system 124 also includes the position sensor 130 that is configured to determine a position of the garage door 108 relative to the structure 104. As such, when the garage door 108 is closed, the control box 126 operates the garage door operator 110 to open the garage door 108, and when the garage door 108 is open, the control box 126 operates the garage door operator 110 to close the garage door 108. In the example, the position sensor 130 is coupled in communication with the control box 126 by a wire cable (e.g., 3-conductor cable), although wireless communication may also be used as required or desired. The position sensor 130 may include a magnetic actuator 500 and a switch 600 as described below in reference to FIGS. 7A and 7B. In other examples, any other sensor type/configuration may be used to enable the access system 124 to function as described herein.

In the examples described herein, the access system 124 (e.g., the control box 126, the user interface 128, the position sensor 130, and any wire cables) can be an add-on component kit for use with existing garage door systems. This enables existing garage door systems to be upgraded for remote outside access without requiring the garage door operator 110 to be replaced and/or upgraded. By having a user interface 128 with only a button and a status indicator on the outside 120, the main access controls for the garage door operator 110 are within the control box 126, which is within the structure 104. Thus, physical access is restricted and reduces or eliminates vulnerability to intrusion attempts. Additionally, since the authentication code is stored on the security device 132 in such a way that is passively accessible to the control box 126, a user does not have to actively navigate a multi-step garage door access application and send a communication signal.

Furthermore, although the access system 124 is described above in reference to a garage structure 104 with a garage door 108 and a garage door operator 110. It is appreciated that the access system 124 can be coupled to, and used with, any other door panel that moves via an electric motor as required or desired. For example, the access system 124 may be used with a gate (e.g., a parking area gate) that slides and or rotate to open and allow access to a controlled area. In other examples, the access system 124 may be used with a storage facility overhead doors, which control access between two interior areas of a structure.

Figure 2:
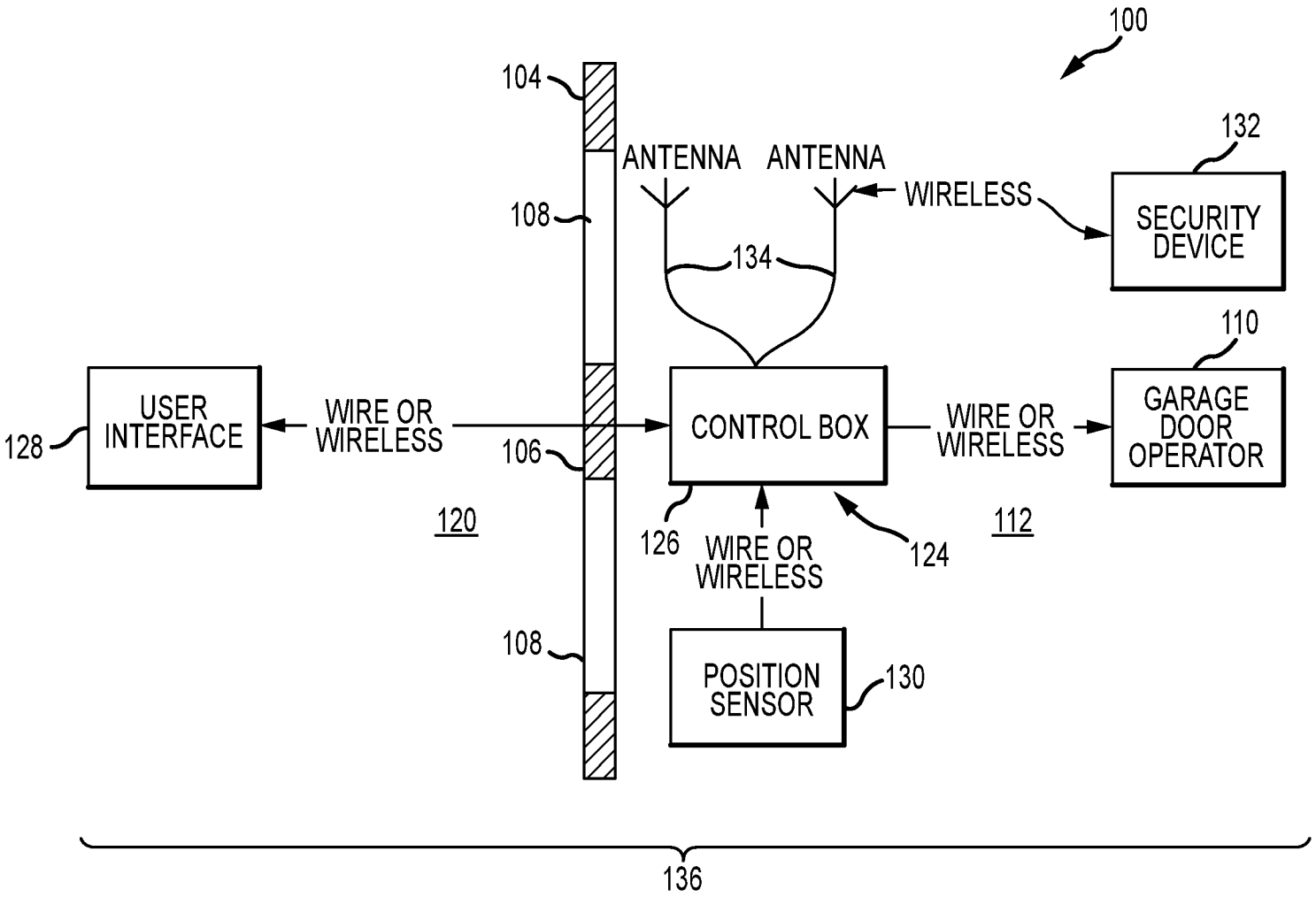
FIG. 2 is a schematic view of the garage door system in a second operating condition.

FIG. 2 is a schematic view of the garage door system 100 in a second operating condition 136. As illustrated in FIG. 2 the security device 132 is positioned within the interior space 112 of the structure 104. As described above, the control box 126 includes at least two antennas 134 so that the access system 124 can determine the location of the security device 132 in relation to the structure 104. For example, one antenna 134 can be positioned and directed to the inside space 112 of the structure 104 and the other antenna 134 can be positioned and directed to the outside space 120 of the structure 104, so that the location of the security device 132 can be determined (e.g., via signal strength). Other methods can also be used as described above.

In the example, the control box 126 may be mounted on the inside of the wall 106 of the structure 104 that the user interface 128 is mounted on, although on the outside. By mounting the control box 126 and the user interface 128 proximate to each other and back-to-back, the configuration enables the antenna range and location determinations to be closely related to the physical position of the user interface 128. Additionally, the control box 126 may include signal amplifiers and/or directors so that the range and location of the security device 132 can be more accurately determined. In some examples, the amplifiers/directors can be components that are coupled around the antennas 134 and within the control box 126 to achieve the desired results.

In operation, when the control box 126 determines that the security device 132 is within the inside space 112 of the structure 104, then upon actuation of the user interface 128 the control box 126 does not operate the garage door operator 110 and the garage door 108 remains in its original position. This restricts unauthorized users from gaining access through the garage door 108 even when an authorized device is present and located within the structure 104. In other examples, the control box 126 may be only configured to restrict the garage door 108 from opening when an authorized device is within the interior space 112 and the user interface 128 is actuated. However, when the garage door 108 is in an open position (e.g., determined by the position sensor 130), then when an authorized device is within the interior space 112 and the user interface 128 is actuated, the control box 126 will operate the garage door operator 110 and close the garage door 108.

Referring concurrently to FIGS. 1 and 2, in an example, a single-family house may include a garage (e.g., structure 104) for parking one or more vehicles. The garage has at least one garage door 108 through which the vehicle may access the garage. The garage may also have one or more doors (not shown) so that the house or yard may be accessed through the garage. The garage door 108 is coupled to a motorized operator 110 that is configured to open or close the garage door 108. The operator 110 can be controlled by a button (e.g., the first remote device 114) that is located adjacent to the door or a remote garage door opener (e.g., the second remote device 116) that is located in the vehicle. However, users that are not within the garage and not within a vehicle may still want to access through the garage door 108. As such, the access system 124 may be connected to the garage door operator 110 and control and enable additional access to the garage.

In the example, the user interface 128 is mounted outside of the garage and near the garage door 108 for facilitating access to the garage. The user interface 128 can be a single button much like a doorbell, because the operational control of the garage door operator 110 is controlled by the control box 126 that is mounted with the garage. When the user interface 128 is actuated without an authorized device present outside of the garage door 108, the control box 126 will not operate the garage door operator 110 and open or close the garage door 108. However, when an authorized device is present and outside of the garage, the control box 126 will operate the garage door operator 110 and open or close the garage door 108 and allow access to the garage. In some examples, if the user interface 128 is actuated without an authorized device present, a notification may be provided to the occupants of the house (e.g., a ring of the doorbell or a flashing light) or a notification may be sent to the authorized devices through the user application interface.

Figure 3:
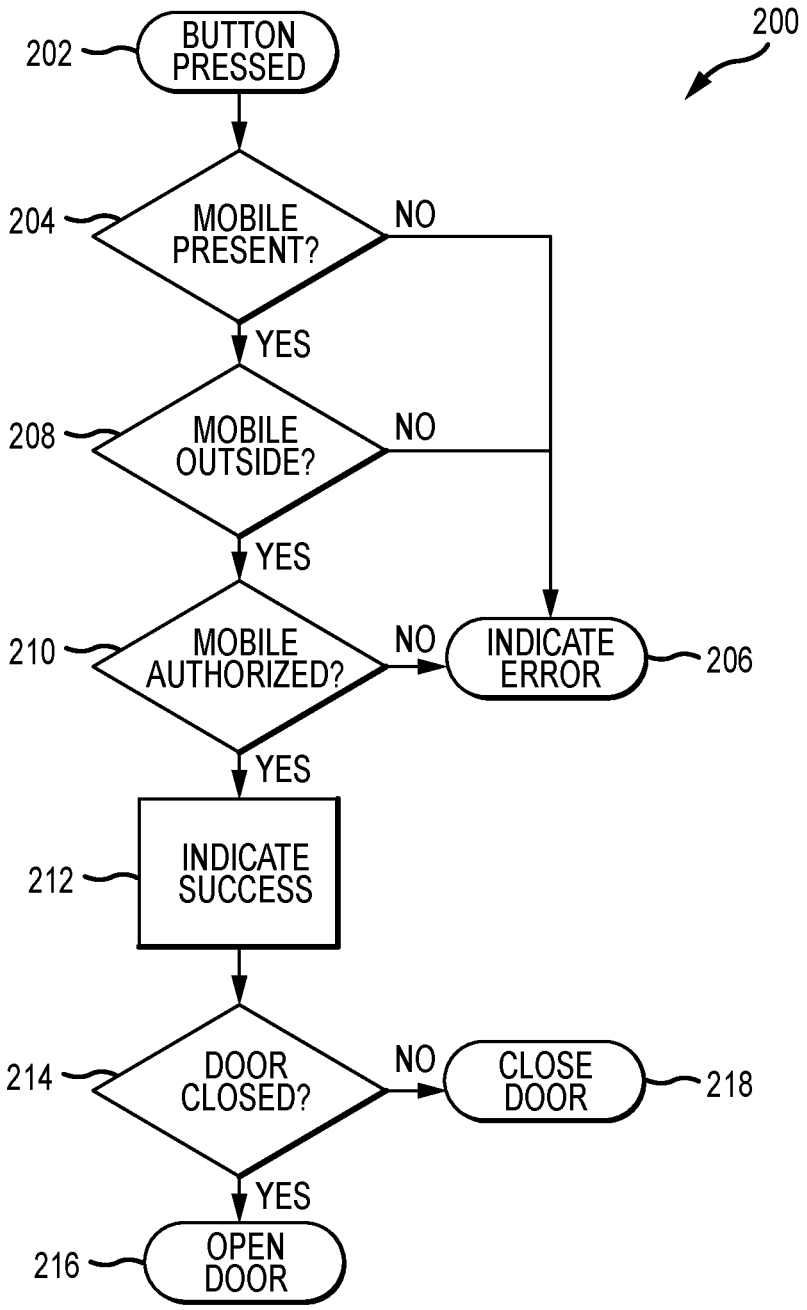
FIG. 3 is flowchart illustrating a method of operating a garage door of a structure.

FIG. 3 is flowchart illustrating a method 200 of operating a garage door of a structure. The method 200 begins with actuating a single button of a user interface mounted within an outside space of the structure (operation 202). Once the button is pressed, the user interface sends an actuation signal that is received by a control box. Upon receipt of the actuation signal the control box detects a presence of a security device (e.g., a mobile device such as a phone, key fob, etc.) relative to the control box (operation 204). The control box can be coupled in communication with the user interface and is typically mounted within an inside space of the structure. In the example, the user interface may be actuated by pressing a button. In other examples, the user interface may include any other component that triggers the control box to determine if the security device is present as required or desired. For example, the user interface may have a touch pad or a motion sensor. If the control box detects that no security device is present within its range, then a status condition (e.g., an error indication) of the control box in relation to operating the garage door operator may be indicated on the user interface (operation 206). For example, a visual signal may be emitted from the user interface.

However, when the control box detects that there is a security device present, then the control box determines a position of the security device relative to the structure (operation 208). If the control box determines that the security device is inside of the structure, then a status condition of the control box may be indicated on the user interface (operation 206). In some examples, the position of the security device may include identifying a signal from the security device on a first antenna that is directed towards the outside space and/or identifying a signal from the security device on a second antenna that is directed towards the inside space. However, when the security device is present and outside of the structure, then the control box determines an authorization of the security device (operation 210). If the control box determines that the security device is unauthorized, then a status condition of the control box may be indicated on the user interface (operation 206).

When the security device is positioned proximate the control box, located on the outside of the structure, and authorized to operate the garage door, the control box can control the garage door via a garage door operator and indicate a status condition (e.g., a success indication) of the control box on the user interface (operation 212). For example, a visual signal may be emitted from the user interface. The control box being operably connected to the garage door operator and configured to open and close the garage door. In some examples, during operation of the garage door, the control box may emit a visual and/or an audible signal that is associated with the opening and closing of the garage door. While operations 204, 208, 210 are illustrated as being in order in FIG. 3, it is appreciated that these operations may be performed at any time and in any order as required or desired.

Once the garage door is to be opened or closed, the method 200 further includes sensing a position of the garage door relative to the structure by a sensor (operation 214). As such, when the garage door is closed, the control box operates the garage door operator to open the garage door (operation 216), and when the garage door is open, the control box operates the garage door operator to close the garage door (operation 218). In some examples, the sensor may include a magnetic actuator and a switch, which is coupled in communication with the control box. During the opening and/or closing of the garage door, the control box may indicate, visually and/or audibly, the operation of the garage door operator.

In comparison with other garage door systems, the access system described herein is simple and easier to operate. A user can approach the garage door and press a doorbell-like button on a user interface. At this point, the control box and the security device communicate automatically without user interaction to determine if the user is authorized to open the garage door. Accordingly, a high security and simple operation system is provided with no key code to remember. Additionally, the access system can be programmed for multiple secondary security devices such that system enables multiple users. Further, detection of users inside or outside of the garage door is enabled.

Figure 4:
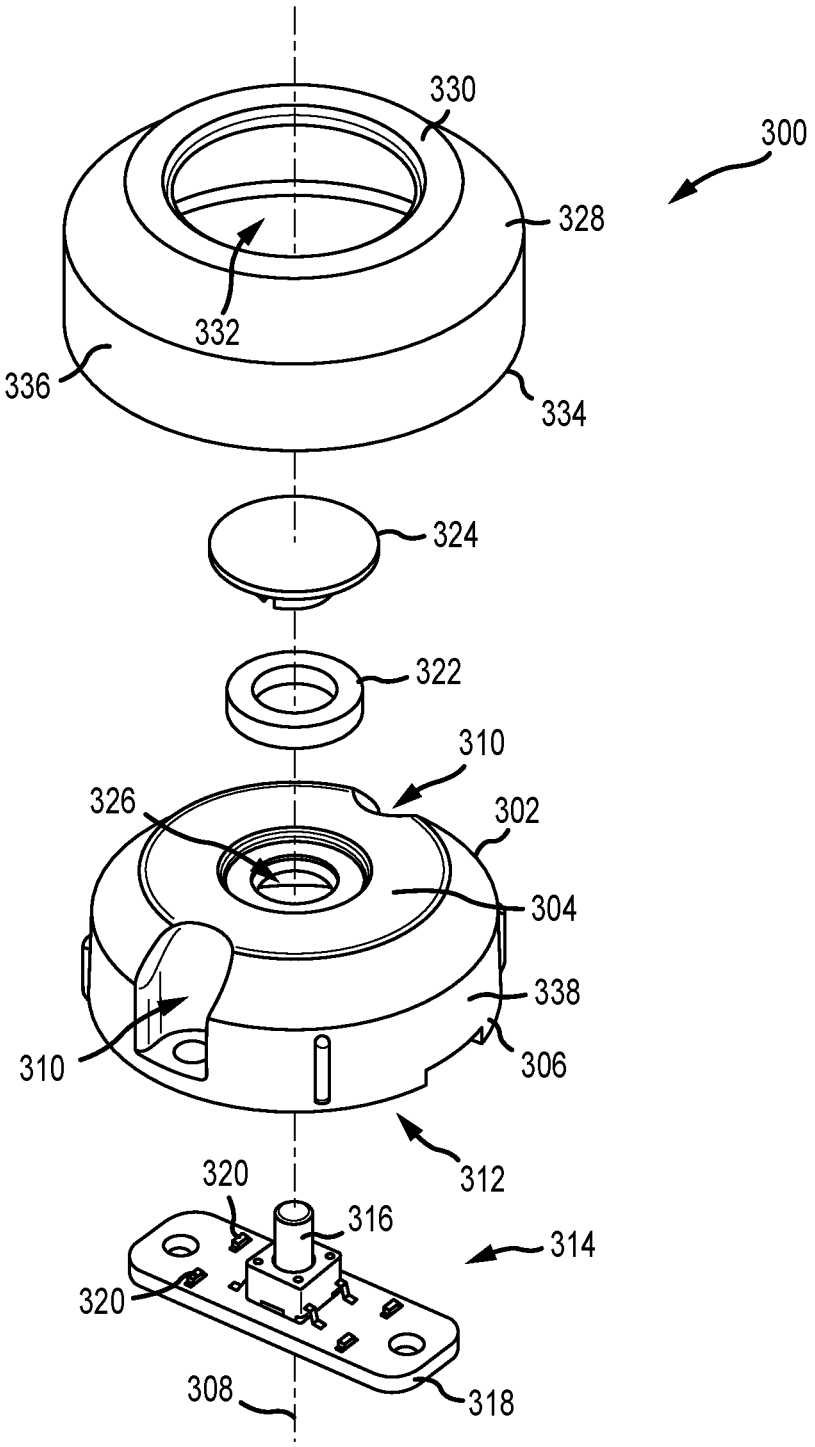
FIG. 4 is an exploded perspective view of a user interface that may be used with the garage door system shown in FIGS. 1 and 2.

FIG. 4 is an exploded perspective view of a user interface 300 that may be used with the garage door system 100 (shown in FIGS. 1 and 2). The user interface 300 includes an inner housing 302 having a first end 304 and a second end 306 that defines a longitudinal axis 308. The second end 306 is configured to be mounted on an exterior wall of the structure, for example, by fasteners (not shown) recessed 310 at 3 o'clock and 9 o'clock positions around the inner housing 302. The inner housing 302 is substantially cylindrical in shape and forms a cavity 312 that is configured to house a circuit board assembly 314 proximate the second end 306. The circuit board assembly 314 can be mounted into the inner housing 302 with two screws 342 (shown in FIG. 5D) that are also used as electric terminals for a two-wire cable so that the user interface 300 can be coupled to the control box (shown in FIGS. 1 and 2).

The circuit board assembly 314 includes a contact switch 316 attached to a circuit board 318 that defines the actuation component of the user interface 300 for garage door operation as described herein. Additionally, one or more light emitting diodes (LEDs) 320 may be coupled to the circuit board 318 to provide a visual indicator on the user interface 300 and identify a status condition of the system. For example, the circuit board assembly 314 may include a red and a green colored LED which can visually indicate an error condition (e.g., the control box restricting operation of the garage door) or a success condition (e.g., the control box enabling operation of the garage door), respectively. In the example, the inner housing 302 can be a translucent plastic to facilitate transmission of light from the LEDs 320. Additionally or alternatively, the circuit board assembly 314 can include a speaker or siren so that an audible indicator can be provided on the user interface 300.

The user interface 300 may also include an elastomeric gasket 322 that is adhered onto the first end 304 of the inner housing 302. In other examples, however, the gasket 322 may not be present. Additionally, a button cap 324 can be snap fit into an aperture 326 defined in the first end 304 of the inner housing 302. The gasket 322 enables the button cap 324 to be biased into an extended position and then depressed so that the contact switch 316 can be actuated. In other examples, the gasket 322 may be a spring or a like component. The gasket 322 additionally supports the button cap 324 so that it does not rattle within the user interface 300 and restricts water ingress into the cavity 312 of the inner housing 302. In some examples, however, the user interface 300 may not be fully water resistant. Rather, water can drain out of the user interface 300 if water penetrates the inner housing 302. In the example, the button cap 324 is aligned with the contact switch 316 along the longitudinal axis 308.

An outer housing 328 is configured to be snap fit around at least a portion of the inner housing 302 and provide protection to the user interface 300 from the exterior elements. The outer housing 238 includes a first end 330 that defines an opening 332 that is configured to receive the button cap 324 and at least a portion of first end 304 of the inner housing 302 so that access is provided. A second end 334 of the outer housing 328 includes a sidewall 336 that is configured to be snap fit onto a sidewall 338 of the inner housing 302.

To mount the user interface 300 on the exterior wall of the garage, the inner housing 302, the gasket 322, and the button cap 324 may be preassembled. The wire connecting the user interface 300 to the control box (shown in FIGS. 1 and 2) can then be attached to the circuit board assembly 314, which is then mounted within the inner housing 302. The inner hosing 302 is then attached to the exterior of the garage and the outer housing 328 snap fit onto the inner housing 302. In some examples, the button cap 324 and the outer housing 328 may be machined from aluminum and then anodized, or plastic injection molded and then plated.

Figure 5A:
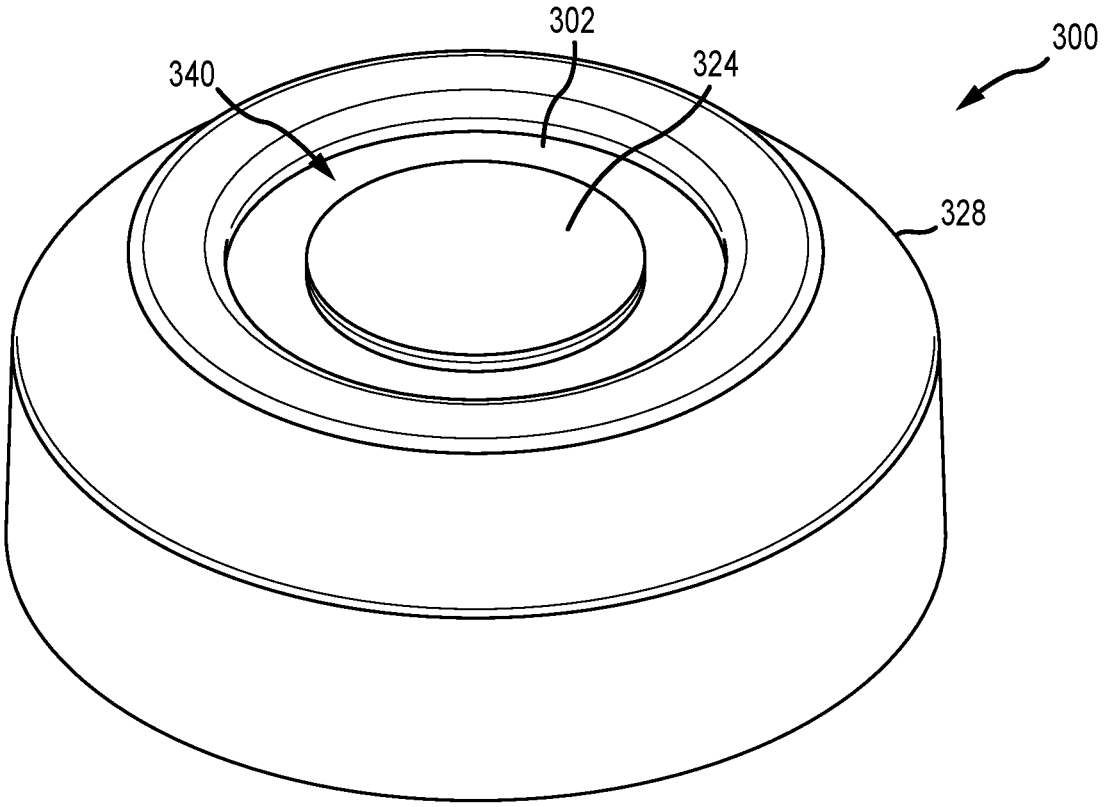
FIG. 5A is a perspective view of the user interface shown in FIG. 4.
Figure 5B:
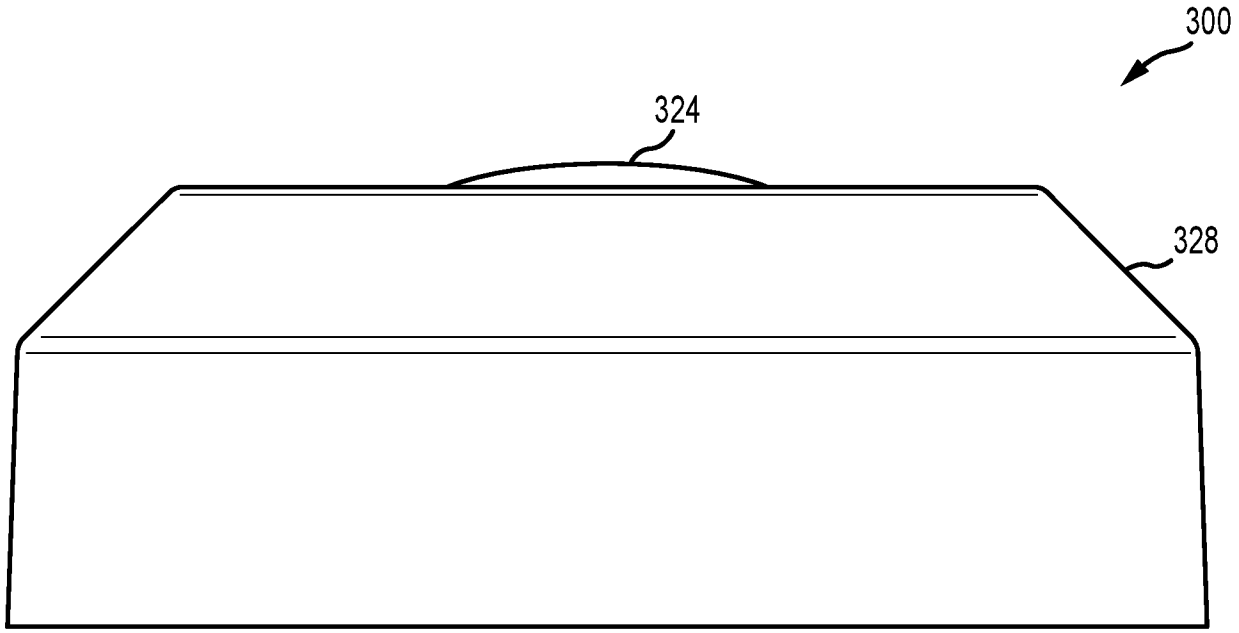
FIG. 5B is a side view of the user interface.
Figure 5C:
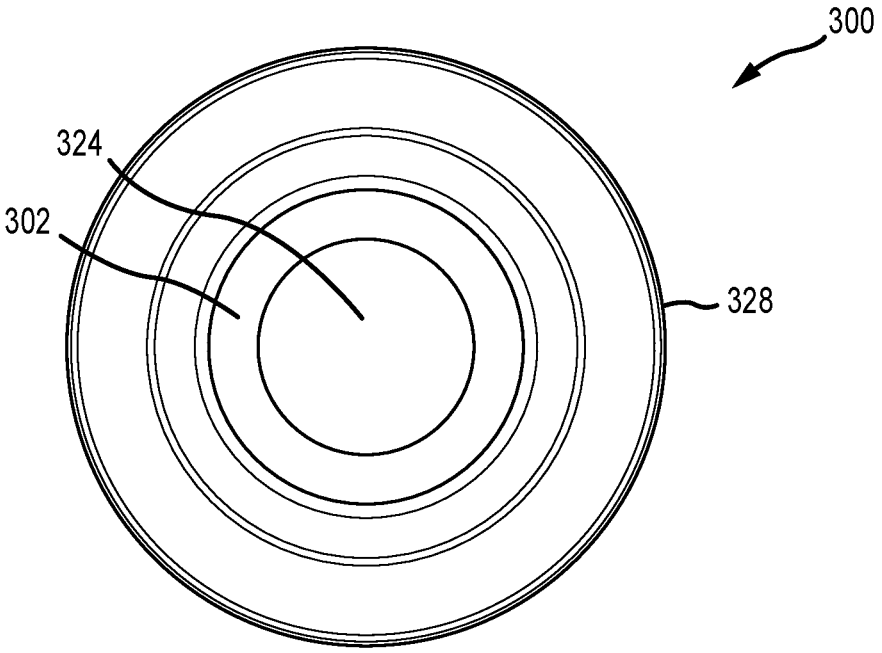
FIG. 5C is a top view of the user interface.
Figure 5D:
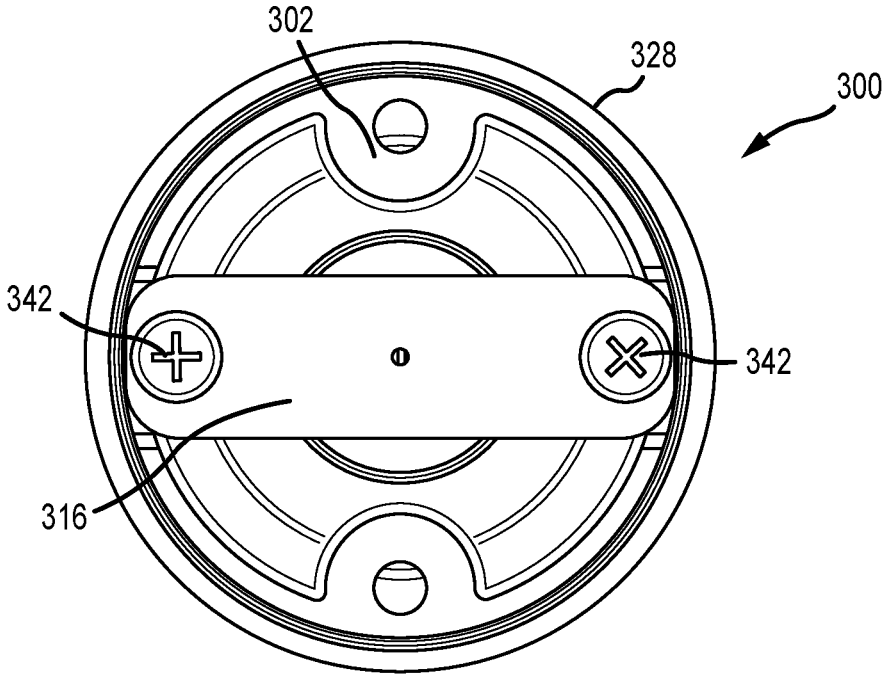
FIG. 5D is a bottom view of the user interface.

FIG. 5A is a perspective view of the user interface 300. FIG. 5B is a side view of the user interface 300. FIG. 5C is a top view of the user interface 300. FIG. 5D is a bottom view of the user interface 300. Referring concurrently to FIGS. 5A-5D, certain components are described above and are not necessary described further. When the user interface 300 is assembled, a gap 340 is formed between the button cap 324 and the outer housing 328 such that a portion of the inner housing 302 is visible. Since the inner housing 302 is translucent, the light from the LEDs is visible on the user interface 300 and is in the shape of a light ring that at least partially surrounds the button cap 324. While a circular-shaped user interface 300 and button cap 324 is illustrated, the user interface 300 and button cap 324 can have any other shape as required or desired (e.g., square or triangle).

Figure 6A:
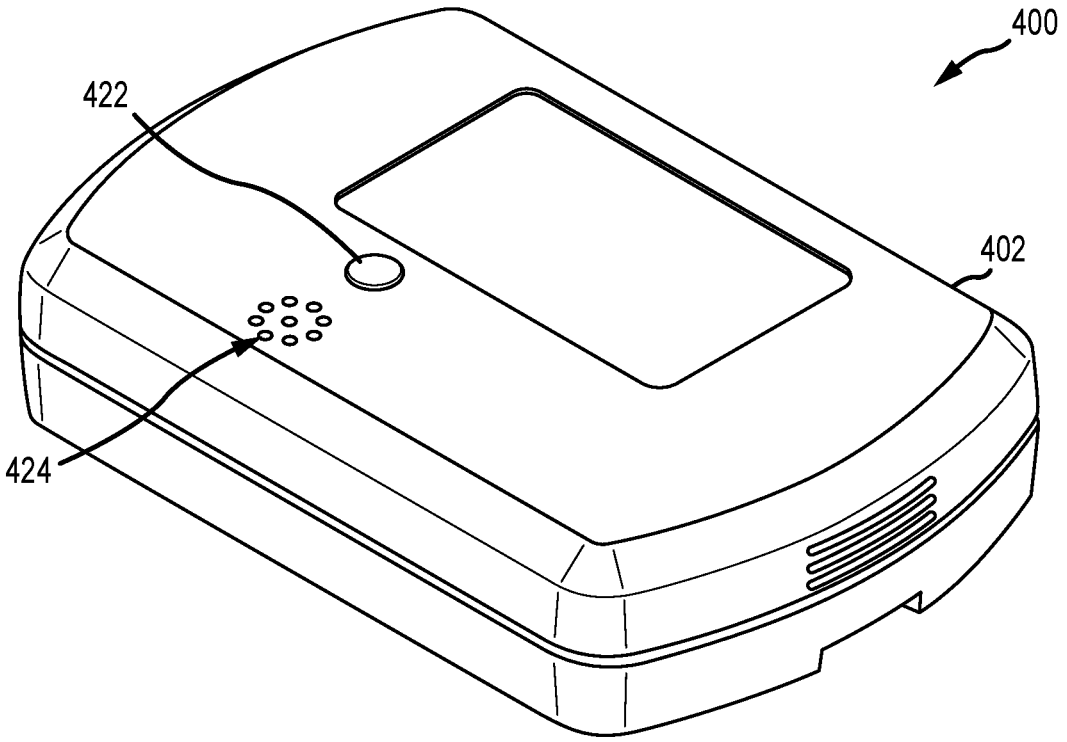
FIG. 6A is a perspective view of a control box that may be used with the garage door system shown in FIGS. 1 and 2.
Figure 6B:
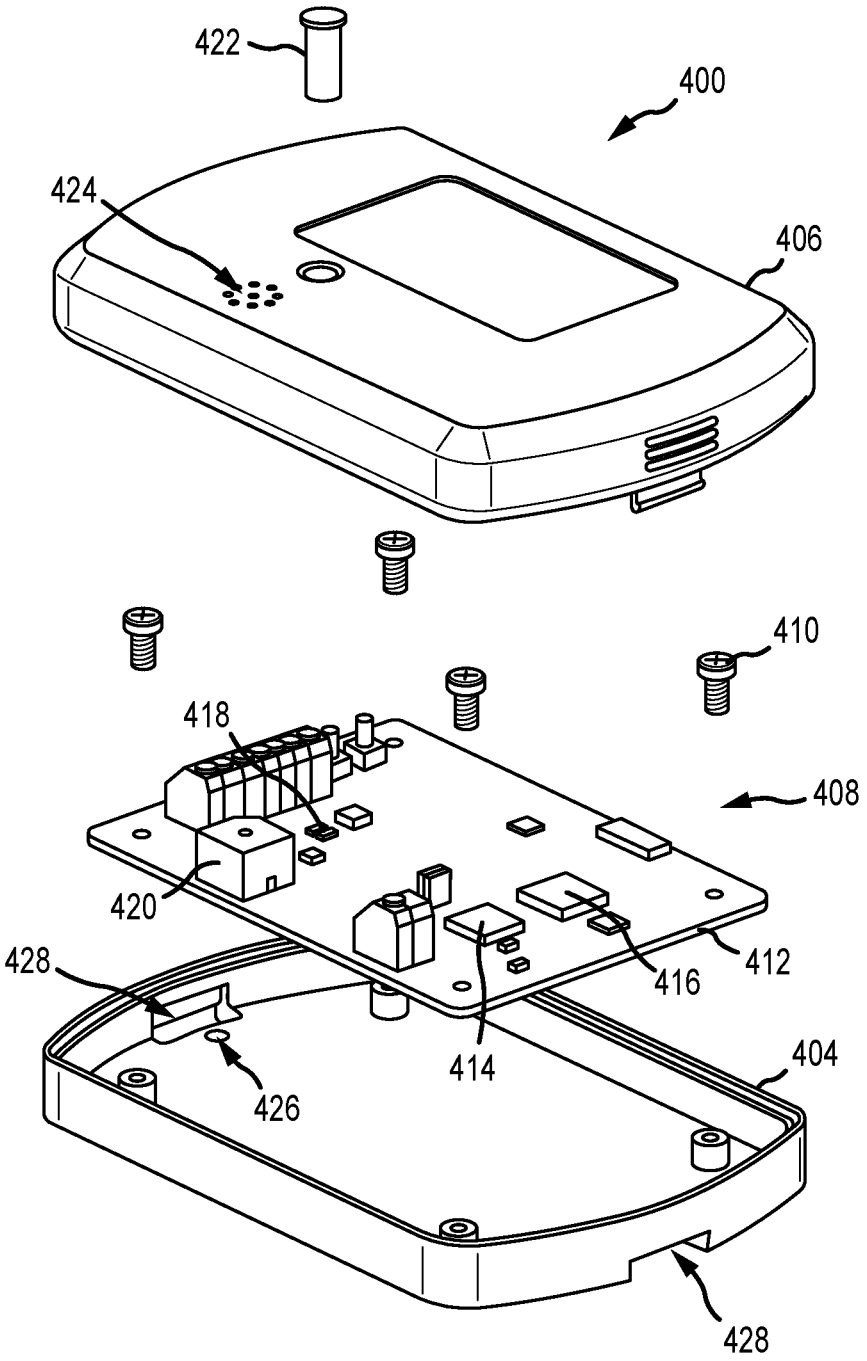
FIG. 6B is an exploded view of the control box.

FIG. 6A is a perspective view of a control box 400 that may be used with the garage door system 100 (shown in FIGS. 1 and 2). FIG. 6B is an exploded view of the control box 400. Referring concurrently to FIGS. 6A and 6B, the control box 400 includes a two piece housing 402 that has a bottom case 404 and a top case 406 that can be snap fit together. Within the housing 402, a circuit board assembly 408 is mounted to the bottom case 404 by one or more screws 410. The circuit board assembly 408 can include a circuit board 412 having at least memory 414 and a processor 416 for performing the system operations as described herein. One or more antennas (not shown) are coupled to the circuit board 412 as described herein. For example, one antenna may be positioned on one side of the circuit board 412 and another antenna on the other in order to determine the position of the security device (shown in FIGS. 1 and 2). The circuit board 412 also includes at least one LED 418 that can visually indicate a status condition of the control box 400, and a siren 420 that can audibly indicate a status condition of the control box 400.

In the example, the control box 400 may both visually indicate and audibly indicate when the garage door is opening and closing. As such, the top case 406 can include a light pipe 422 that is positioned proximate the LED 418 and one or more sound apertures 424 that are positioned proximate the siren 420. The light pipe 422 can be snap fit into the top case 406. In one example, the LED 418 can indicate green for a ready condition and red for an operating condition (e.g., as the garage door is opening or closing), while the siren can audibly indicate the garage door movement. Other status indicators for the control box 400 may be utilized as required or desired.

The bottom case 404 is configured to be mounted on the interior wall of the garage as described above. In one example, the bottom case 404 may be mounted with two screws (not shown) that extend through mounting apertures 426 on the back wall of the bottom case 404. Additionally, one or more slots 428 are defined in the bottom case 404 so that the wire cables (e.g., from the user interface, garage door operator, and sensor) can be routed to the circuit board assembly 408. Additionally, the control box 400 may include a power adapter (not shown) that is configured to provide power to the system. In some examples, the control box 400 may be connected to the structure's power source lines directly.

Figure 7A:
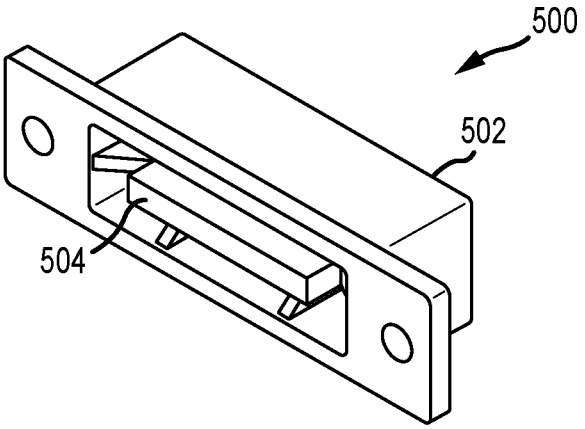
FIG. 7A is a perspective view of a magnetic actuator that may be used with the garage door system shown in FIGS. 1 and 2.

FIG. 7A is a perspective view of a magnetic actuator 500 that may be used with the garage door system 100 (shown in FIGS. 1 and 2). In the example, the magnetic actuator 500 may include a housing 502 that is injection molded plastic and a magnet 504 that is press fit into the housing 502. In an example, the magnet 504 may be a neodymium-based material. In operation, the assembled magnetic actuator 500 can be mounted to a top edge of an overhead garage door with one or more screws through the housing 502. In other examples, however, the actuator 500 may be mounted at any location along the edge of the garage door as required or desired.

Figure 7B:
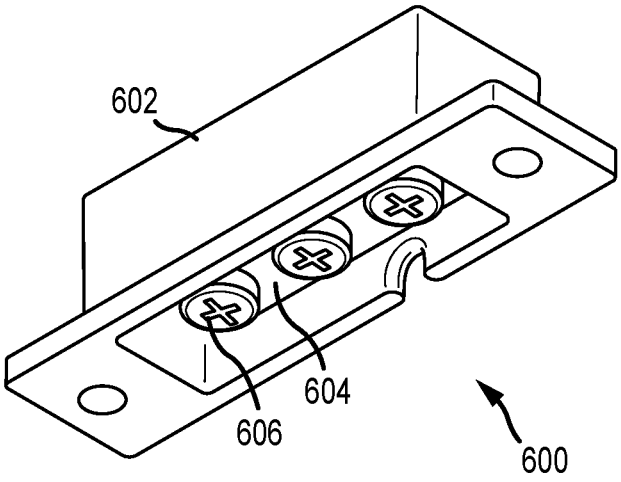
FIG. 7B is a perspective view of a sensor switch that may be used with the garage door system shown in FIGS. 1 and 2.

FIG. 7B is a perspective view of a sensor switch 600 that may be used with the garage door system 100 (shown in FIGS. 1 and 2). In the example, the sensor switch 600 may include a housing 602 that is injection molded plastic and a circuit board assembly 604 having one or more magnetic sensors (not shown). The circuit board assembly 604 can be secured within the housing 602 by three-screws 606 that also act as the electric terminals for the wire cable (not shown) that connects the sensor switch 600 to the control box (shown in FIGS. 1 and 2). In operation, the assembled sensor switch 600 can be mounted to a doorframe adjacent to the magnetic actuator 500 when the overhead door is in the closed position. As such, when the sensor switch 600 senses the magnetic actuator 500, the control box can determine that the garage door is closed, and when the sensor switch 600 cannot sense the magnetic actuator 500, the control box can determine that the garage door is open. Any other position sensor and/or sensor location may be used that enables the system to function as described herein.

Figure 8:
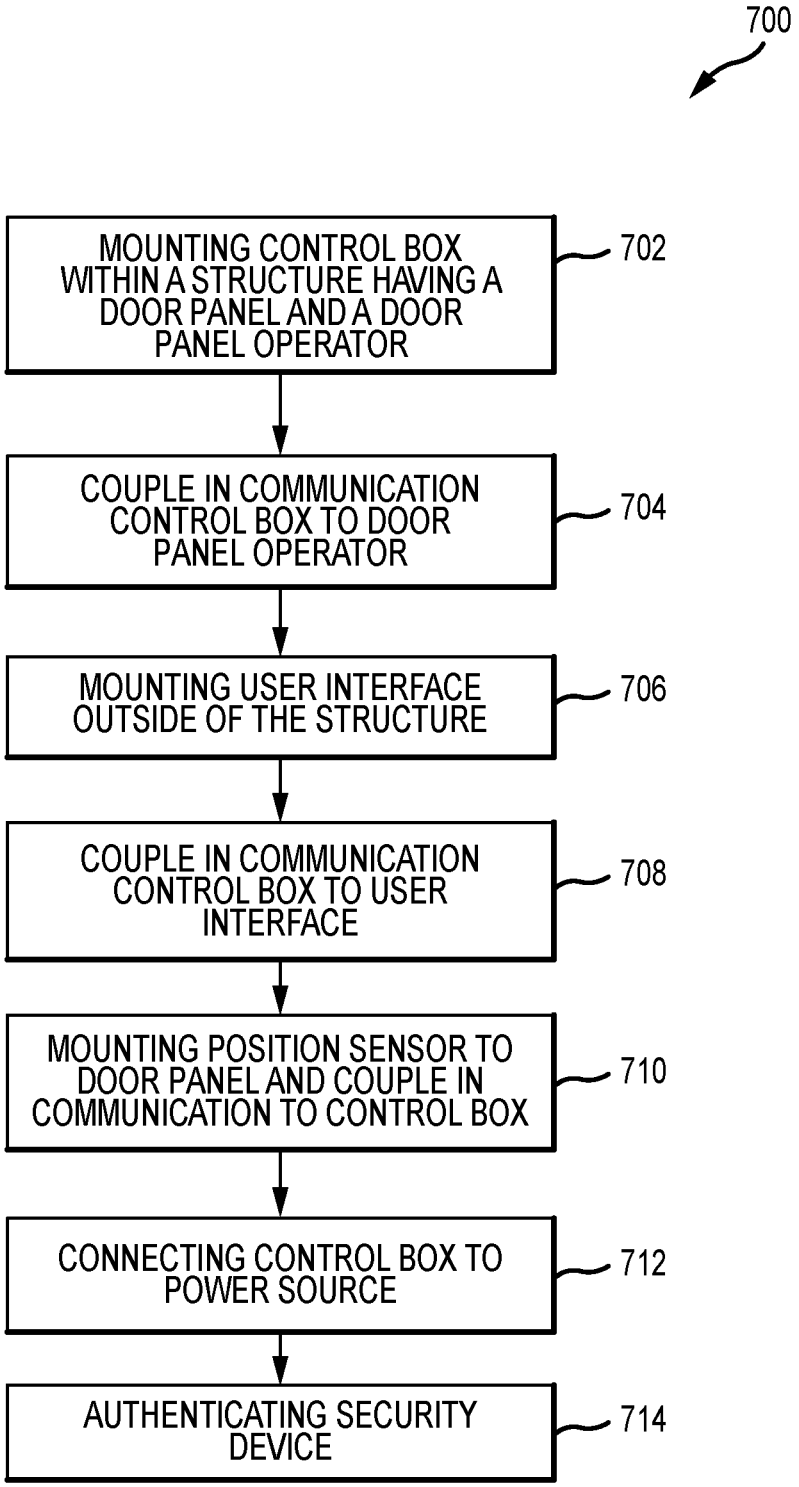
FIG. 8 is a flowchart illustrating a method of installing an access system on a garage door operator.

FIG. 8 is a flowchart illustrating a method 700 of installing an access system on a garage door operator. The control box is mounted within a structure having a garage door and a pre-installed garage door operator (operation 702). The control box can then be coupled in communication with the garage door operator by a wire cable (operation 704). Additionally, a user interface is mounted on the outside of the structure (operation 706). The user interface can then be coupled in communication with the control box by a wire cable (operation 708). Further, a position sensor is mounted to the garage door and coupled in communication to the control box by a wire cable (operation 710). Once the control box, the user interface, and the position sensor are mounted the control box can be connected to a power source (operation 712), and one or more security devices can be authenticated with the control box (operation 714) for further use in controlling operation of the garage door as described above. This enables existing garage door systems to be upgraded for remote outside access.

The materials utilized in the manufacture of the access system components described herein may be those typically utilized for garage door manufacture, e.g., zinc, steel, aluminum, brass, stainless steel, etc. Molded plastics, such as PVC, polyethylene, etc., may be utilized for the various components. Material selection for most of the components may be based on the proposed location of the components (e.g., inside or outside) subject to certain environmental conditions (e.g., moisture, corrosive atmospheres, etc.).

Any number of features of the different examples described herein may be combined into one single example and alternate examples having fewer than or more than all the features herein described are possible. It is to be understood that terminology employed herein is used for the purpose of describing particular examples only and is not intended to be limiting. It must be noted that, as used in this specification, the singular forms "a," "an," and "the" include plural referents unless the context clearly dictates otherwise.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An access system for a structure, the access system comprising:

a control box mounted within a controlled access space of the structure and operatively coupled to a door panel operator that opens and closes a door panel of the structure for access to the controlled access space, wherein the control box is configured to (i) detect a presence of a security device relative to the control box, (ii) determine a position of the security device relative to the structure, and (iii) determine an authorization of the security device, wherein the control box comprises at least two antennas for determining position of the security device, and wherein a first antenna is directed to the controlled access space of the structure and a second antenna is directed to an uncontrolled access space of the structure; and a user interface mounted in the uncontrolled access space of the structure and coupled in communication with the control box, the user interface being independent and remote from the control box and comprising a single button, wherein upon actuation of the single button, the control box operates the door panel operator when the security device is (i) positioned proximate the control box, (ii) located in the uncontrolled access space of the structure, and (iii) authorized to operate the door panel.

2. The access system of claim 1, further comprising a sensor configured to determine a position of the door panel relative to the structure such that when the door panel is closed, the control box operates the door panel operator to open the door panel, and when the door panel is open, the control box operates the door panel operator to close the door panel.

3. The access system of claim 2, wherein the sensor comprises a magnetic actuator and a switch.

4. The access system of claim 3, wherein the switch is coupled in communication to the control box by a wire cable.

5. The access system of claim 1, wherein the user interface is coupled to the control box by a wire cable.

6. The access system of claim 1, wherein the user interface comprises at least one visual indicator configured to indicate a status condition of the control box in relation to operating the door panel operator.

7. The access system of claim 1, wherein the control box is mounted on a wall of the structure that is the same wall that the user interface is mounted on.

8. The access system of claim 1, wherein the control box comprises at least one of an audio indicator and a visual indicator configured to indicate operation of the door panel operator.

9. An access system kit for a garage door operator configured to open and close a garage door relative to a structure, the kit comprising:

a control box for mounting within a controlled access space of the structure, the control box being operably connectable to the garage door operator and configured to (i) detect a presence of a security device relative to the control box, (ii) determine a position of the security device relative to the structure, and (iii) determine an authorization of the security device, wherein the control box comprises at least two antennas for determining position of the security device, and wherein a first antenna is directed to the controlled access space of the structure and a second antenna is directed to an uncontrolled access space of the structure; and a discrete user interface for mounting in the uncontrolled access space of the structure and comprising a single button, the user interface being communicatively connectable to the control box such that upon actuation of the single button, the control box operates the garage door operator when the security device is (i) positioned proximate the control box, (ii) located in the uncontrolled access space of the structure, and (iii) authorized to operate the garage door.

10. The kit of claim 9, further comprising:

a sensor configured to determine a position of the garage door relative to the structure, wherein the sensor comprises a magnetic actuator and a switch; and a wire cable configured to communicatively connect the switch to the control box.

11. The kit of claim 9, further comprising a wire cable configured to connect the user interface to the control box.

12. The kit of claim 9, further comprising a wire cable configured to connect the control box to the garage door operator.

13. The kit of claim 9, wherein the user interface comprises:

an inner housing comprising a first end and a second end defining a longitudinal axis therethrough, wherein the second end is configured to be mounted within the uncontrolled access space of the structure;

a contact switch disposed within the inner housing;

a button mounted to the first end of the housing, wherein the button is aligned with the contact switch along the longitudinal axis, and wherein upon actuation of the button the contact switch is actuated; and an outer housing configured to surround at least a portion of the inner housing, wherein the outer housing defines an opening, and wherein at least a portion of the first end and the button are disposed within the opening.

14. The kit of claim 13, wherein the user interface further comprises a visual indicator disposed within the inner housing, wherein the inner housing is at least partially transparent such that the visual indicator is visible through the opening of the outer housing and at least partially surrounding the button.

15. A method of operating a door panel of a structure, the method comprising:

receiving an actuation signal at a control box from an independent and remotely located user interface mounted in an uncontrolled access space of the structure;

detecting, by the control box, a presence of a security device relative to the control box, wherein the control box is coupled in communication with the user interface and is mounted within a controlled access space of the structure;

determining, by the control box, a position of the security device relative to the structure, wherein determining the position of the security device comprises at least one of identifying a signal from the security device on a first antenna that is directed towards the uncontrolled access space and identifying a signal from the one or more security device on a second antenna that is directed towards the controlled access space;

determining, by the control box, an authorization of the security device; and controlling a door panel operator configured to open and close the door panel based on the security device being (i) positioned proximate the control box, (ii) located in the uncontrolled access space of the structure, and (iii) authorized to operate the door panel, wherein the control box is operably connected to the door panel operator.

16. The method of claim 15, further comprising sensing a position of the door panel relative to the structure by a sensor such that when the door panel is closed, the control box controls the door panel operator to open the door panel, and when the door panel is open, the control box controls the door panel operator to close the door panel.

17. The method of claim 15, further comprising emitting a visual signal from the user interface based on a status condition of the control box in relation to controlling the door panel operator.

18. The method of claim 15, further comprising emitting at least one of a visual and an audible signal from the control box associated with control of the door panel operator.

* * * * *